United States Patent [19]

Pennestri

[11] Patent Number: 4,924,532

[45] Date of Patent: May 15, 1990

[54] CLEANING AND SANITIZING SYSTEM FOR A TOILET SEAT

[76] Inventor: Domenick Pennestri, Bay Shore Yacht & Tennis Club, 19451 Gulf Blvd., Indian Shores, Fla. 34635

[21] Appl. No.: 349,440

[22] Filed: May 9, 1989

[51] Int. Cl.[5] ..... A47K 13/00

[52] U.S. Cl. ..... 4/233; 4/222

[58] Field of Search ..... 4/222, 223, 224, 229, 4/233, 251, 661, 662

[56] References Cited

U.S. PATENT DOCUMENTS

| | | | |
|---|---|---|---|
| 1,877,689 | 9/1932 | Peterson | 4/233 |
| 2,458,019 | 1/1949 | Niles | 4/233 |
| 2,605,478 | 8/1952 | Lessiter | 4/233 |
| 4,242,764 | 1/1981 | Fukuda | 4/233 |
| 4,713,845 | 12/1987 | Bono | 4/233 |

FOREIGN PATENT DOCUMENTS

| | | | |
|---|---|---|---|
| 2132688 | 1/1972 | Fed. Rep. of Germany | 4/233 |
| 2812554 | 9/1979 | Fed. Rep. of Germany | 4/233 |
| 2907754 | 9/1980 | Fed. Rep. of Germany | 4/233 |
| 8502214 | 5/1985 | PCT Int'l Appl. | 4/222 |

*Primary Examiner*—Henry J. Recla
*Assistant Examiner*—Glenn T. Barrett
*Attorney, Agent, or Firm*—Terry M. Gernstein

[57] ABSTRACT

A toilet seat is cleaned and sanitized by directing first liquid and then gas thereagainst from a hose. A switch is closed when a toliet seat cover is closed to initiate operation of a liquid system and a timer is included to shut off the liquid system. The liquid system is connected to a gas system to initiate operation of the gas system after the liquid system is shut down, and the gas system is connected to the switch to re-set that switch when the gas system is shut down. Both the liquid and the gas system are connected to the hose and valves are included to prevent intermingling of the fluids. The toilet seat includes a groove and the cover includes a tongue on a flange that mates with the groove to seal the cover to the seat in a fluid-tight manner.

7 Claims, 2 Drawing Sheets

CLEANING AND SANITIZING SYSTEM FOR A TOILET SEAT

TECHNICAL FIELD OF THE INVENTION

The present invention relates to the general art of plumbing fixtures, and to the particular field of toilets. Specifically, the present invention relates to cleaning systems used in conjunction with toilet seats.

BACKGROUND OF THE INVENTION

There has been an overall heightened awareness of sanitation conditions in community bathrooms in recent times. Specifically, due to the existence of many communicable diseases, there has been interest in ensuring the sanitary and clean conditions of all toilet seats, and such seats as are found in community bathrooms in particular.

Accordingly, there have been many proposals for maintaining sanitary conditions for such devices. For example, systems such as disclosed in U.S. Pat. No. 4,063,316 are intended to clean and disinfect toilet seats. However, such systems, while somewhat successful, have several drawbacks which prevent them from gaining widespread acceptance.

Specifically, systems, such as the just-mentioned patented system, accomplish their objectives by spraying a fluid over the toilet seat from outlets in that seat. This can be a messy operation in which liquid splashes out of the toilet and onto the floor and other adjacent fixtures. Still further, even after being cleaned, the seats in such systems are still exposed to the air and possible airborne germs which can defeat or vitiate at least some of the gained cleaning objectives of the system.

Still further, systems, such as the just-mentioned patented system, which use a plurality of fluids, such as liquid and gas, are subject to co-mingling of such fluids in the sources thereby raising the possibility of damaging the systems associated with the individual fluids.

Accordingly, there is a need for a toilet seat cleaning system which achieves the objective of cleaning, sanitizing and sterilizing a toilet seat in a neat manner and which protects a cleaned seat from contamination between uses.

OBJECTS OF THE INVENTION

It is a main object of the present invention to provide a system for cleaning and disinfecting a toilet seat in a neat and controlled manner.

It is another object of the present invention to provided a system for cleaning and sterilizing a toilet seat in which fluids used to carry out the process are contained within the toilet.

It is another object of the present invention to provide a system for cleaning and sterilizing a toilet seat in which fluids used to carry out the process are contained within the toilet, and which there is little if any chance of co-mingling the fluids.

It is another object of the present invention to provided a system for cleaning and sterilizing a toilet seat in which fluids used to carry out the process are contained within the toilet using a single hose to dispense all fluids onto the toilet seat.

SUMMARY OF THE INVENTION

These, and other, objects are achieved by providing a toilet seat cover that fluidically seals the toilet when the cover is in the closed position and has a fluid dispensing hose mounted on the cover to impinge fluid against the toilet seat within the sealed toilet. The hose is connected to a source of gas as well as to a source of liquid and includes flow control valves to prevent co-mingling of such fluids in the sources. The system further includes timer means associated with each of the fluid sources so such fluids will be dispensed in timed relation to each other.

By sealing the toilet, the fluids, especially the liquids, can be dispensed with great force against the seat without danger of splashing out of the toilet. In this manner, not only will the cleaning process remain neat and fully contained, the process can be more effective than prior processes due to the increased fluid pressure.

Still further, the system embodying the present invention includes but a single hose for all fluids, and thus is easily retrofit in existing toilets as well as being efficient to install.

Due to the sealed nature of the toilet, the cleaned toilet seat will not be subject to further contamination after it has been cleaned.

DETAILED DESCRIPTION OF THE PREFERRED EMBODIMENT OF THE INVENTION

Figure 1:
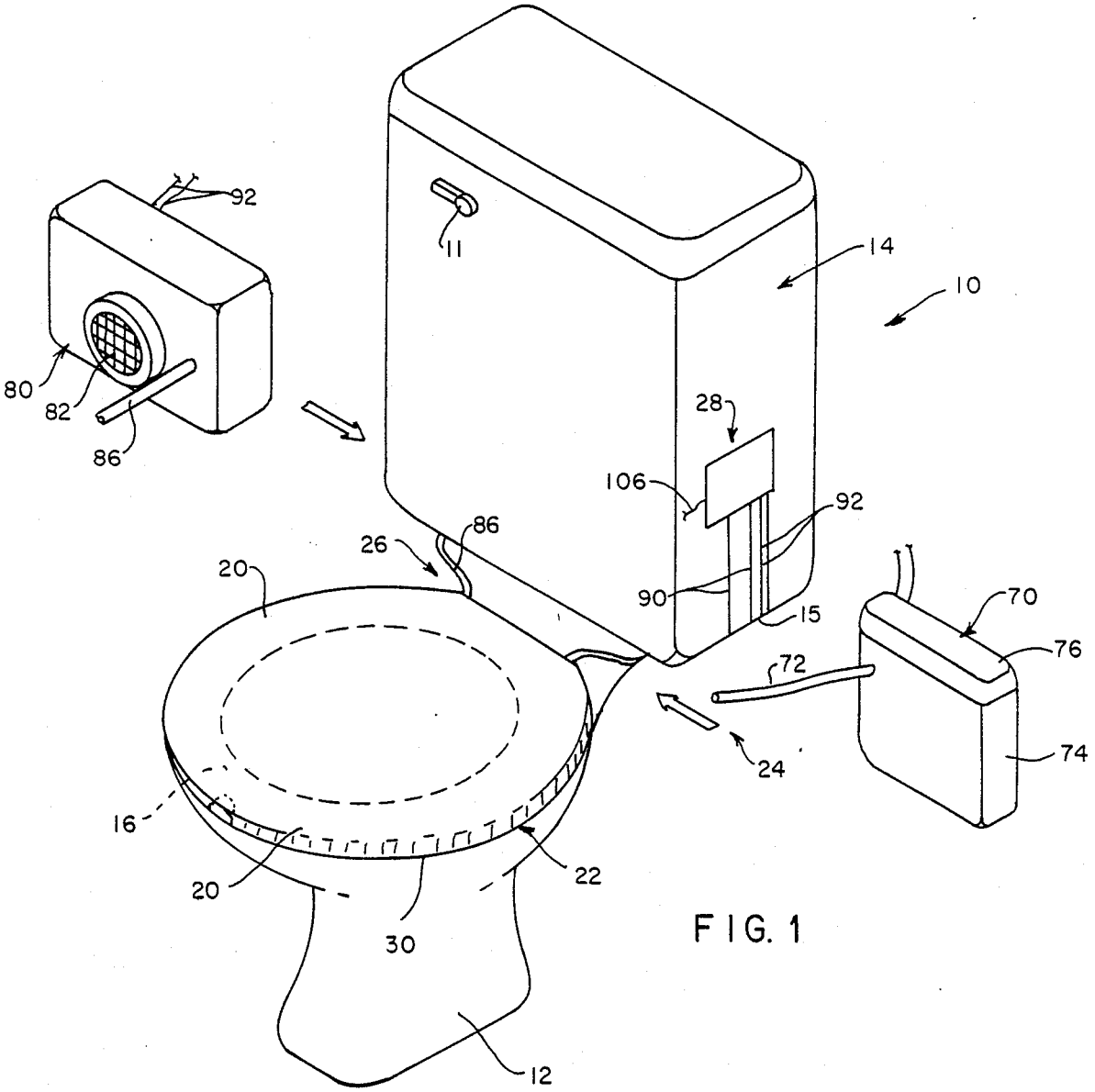
FIG. 1 is an exploded perspective of the overall toilet seat cleaning system of the present invention showing the toilet seat cover in the closed and sealed configuration.
Figure 2:
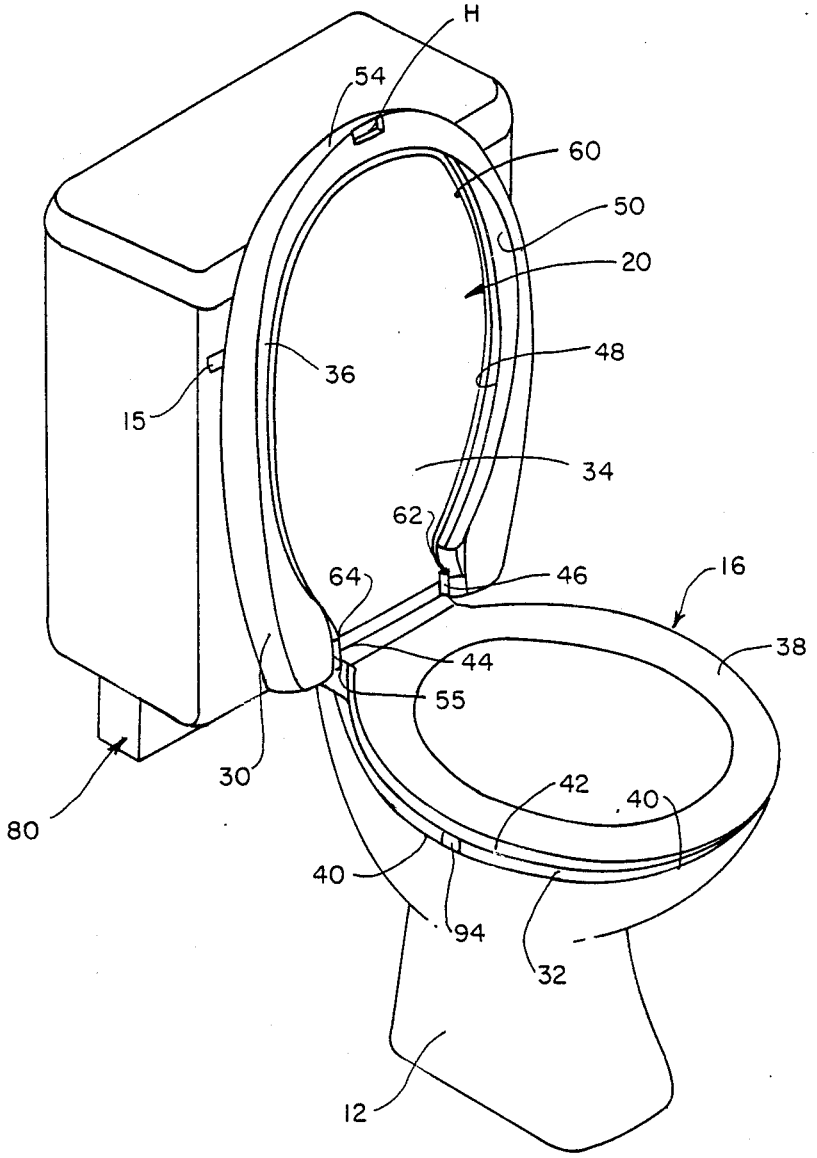
FIG. 2 is a perspective of the overall toilet seat cleaning system showing the toilet seat in the open configuration.

Shown in FIGS. 1 and 2 is a toilet 10 which includes a bowl 12 and a tank 14 having a bottom 15 which are connected together in the usual manner to provide a flushing action common to toilets in response to operation of a flush mechanism which includes a handle 11. The toilet 10 also includes a toilet seat 16 and a toilet seat cover 20 hingeably mounted on the bowl in the usual manner to close the toilet in the FIG. 1 configuration and to open the toilet in the FIG. 2 configuration.

The toilet 10 includes a system for cleaning, sanitizing, disinfecting and sealing the toilet after and between uses. This system includes a fluid sealing means 22 on the cover 20, a liquid seat-cleaning system 24 and a gas seat-cleaning system 26 which are controlled and operated in timed relation with each other by a control and power system 28.

Figure 3:
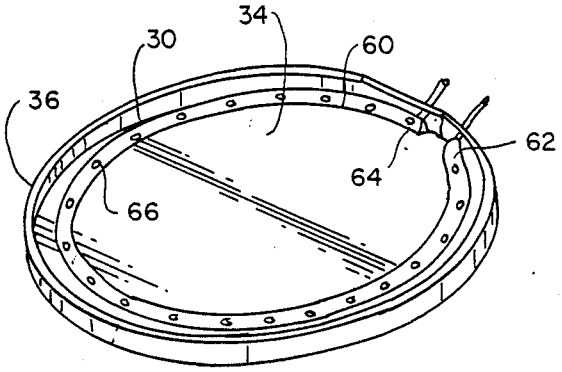
FIG. 3 is a bottom perspective of the toilet seat cover of the present invention showing the sealing elements thereof.

As best shown in FIGS. 2 and 3, the sealing means 22 includes a flange 30 which is monolithic with the cover 20 and which depends from the perimeter thereof to contact the outer surface 32 of the seat 16 in a fluid-tight manner so as to fluidically seal the cover to the toilet seat in the closed configuration of the toilet as shown in FIG. 1. The flange 30 is thus shaped to correspond to the outer perimeter shape of the toilet seat and depends from the undersurface 34 of the cover a distance far enough to effect the just-mentioned fluid-tight sealing of the toilet. For example, the flange 30 may have a width as measured from the cover undersurface 34 to rim 36 of the flange that exceeds the thickness of the toilet seat as measured from top surface 38 thereof to bottom surface 40 thereof.

The toilet seat has a groove 42 defined in the outer peripheral surface 32 thereof to extend around the outer surface of that seat from adjacent to hinge 44 to adjacent to hinge 46 which attach the cover to the seat and to the bowl.

The flange includes a tongue 48 on inner surface 50 thereof. The tongue is located on the flange to engage the groove 42 of the seat when the cover is in the FIG. 1 closed configuration to seal the cover closed. The tongue is formed of a flexible plastics-type material, such as Teflon, or the like, that will deform sufficiently to permit the tongue to pass over the seat outer surface and into the groove to close the cover, and then out of the groove and back over the seat outer surface to open the cover. Rubber can also be used for the tongue if suitable.

The tongue and groove are shaped so that the groove grasps the tongue with the least amount of force adjacent to distal portion 54 of the cover whereby a lifting force applied to the cover at the distal portion will release the tongue from the groove in a sequentially continuous manner from the distal portion 54 around the seat to proximal portion 56 adjacent to the hinges 44 and 46. This will permit the cover to be opened and closed easily due to the leverage applied to the tongue and groove combination as the cover is moved.

Figure 2B:
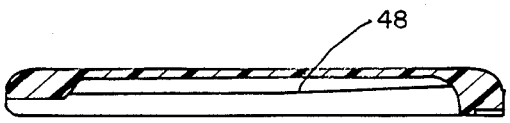
FIG. 2B is a portion of a groove used to seal the cover to the seat of the toilet seat cleaning system of the present invention showing how the groove varies in depth.
Figure 2A:
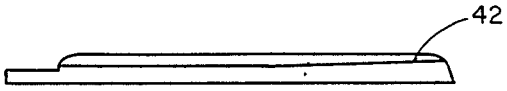
FIG. 2A is a portion of a tongue used in the toilet seat cleaning system of the present invention showing how the tongue varies in width.

As best shown in FIGS. 2, 2A and 2B, such arrangement of the groove and tongue are achieved in the preferred embodiment by having the groove depth as measured between the outer surface 32 of the seat to the bottom of the groove to be shallowest adjacent to the distal portion 54 and the deepest adjacent to the proximal portion 55, with the tongue 48 being shaped to have a width as measured between a root thereof and an inner edge which corresponds to the inner surface 50 of the flange 30 and the depth of the groove in the seat, varies in conjunction with the variation of the groove depth so that the widest portion of the tongue is located to engage the deepest portion of the groove. The cover can also include a hand grasping portion H at the distal portion thereof to ease the operation of the cover.

Since the flange width exceeds the thickness of the toilet seat, the undersurface 34 of the cover will be spaced slightly above the top surface of the toilet seat when the cover is closed. A hose 60 is located in this space. The hose 60 includes a first end 62 which is part of the liquid system 24 and a second end 64 which is part of the gas system 26. The hose 60 further includes a multiplicity of outlet openings, such as opening 66, that are spaced apart along the length dimension of the hose as measured between the two ends thereof.

The openings are directed toward the toilet seat upper surface and are angled inwardly of the toilet when the cover is in the closed configuration and are fluidically connected to the inner bore of the hose. By this orientation, fluid from the hose is directed downwardly from the hose against the upper surface of the toilet seat but in a direction that sends the fluid toward the inside of the bowl after it impinges against the toilet seat. Such directing of the fluid from the hose coupled with the fluid-tight sealing of the cover to the cover to the seat ensures that such fluid will be contained within the toilet and will not splash out of the toilet. The fluid-tight seal will also ensure that once cleaned, the seat will not be exposed to contamination.

As best shown in FIG. 1, the fluid system 24 includes a reservoir/pump assembly 70 that is mounted on the tank 14 on the bottom 15 of that tank. The assembly 70 is fluidically connected to the hose end 62 by a conduit 72 to pump fluid from the reservoir to the hose to be dispensed against the toilet seat via the openings 66. The fluid is preferably disinfectant, but can be water or the like if desired. The assembly 70 includes an outer housing 74 having a removable top 76 so that it can be refilled as needed. The pump is a simple positive displacement-type pump, such as a rotary, piston or centrifugal type pump and is immersed in the fluid in the reservoir. If desired, the pump can be located in its own chamber within the housing and fluidically connect the fluid reservoir to the conduit 72. At any rate, the pump moves fluid from the assembly to the conduit 72.

The gas system 26 is shown in FIG. 1 as including a gas heating and dispensing unit 80 that has an inlet 82 open to the atmosphere to draw air thereinto, and an outlet 84 fluidically connected to the hose end 64 by a conduit 86. The unit 80 includes a simple fan and electric heating element, in the nature of a hand-held hair dryer unit and is mounted on the tank bottom 15.

Heated air is moved from the unit 80 via the conduit 86 to the hose 60 and then from the openings 66 of that hose onto the toilet seat to dry that seat.

As will be discussed below, the units 70 and 80 operate in timed relation with each other so that the liquid system 24 is actuated when the cover is opened and then closed, and is operated a predetermined length of time to wash the seat, after which time, the gas system 26 is actuated to dry the seat. After a selected length of time, the gas system is shut off, and the cycle will begin again as soon as the cover is lifted and then closed again.

Figure 4:
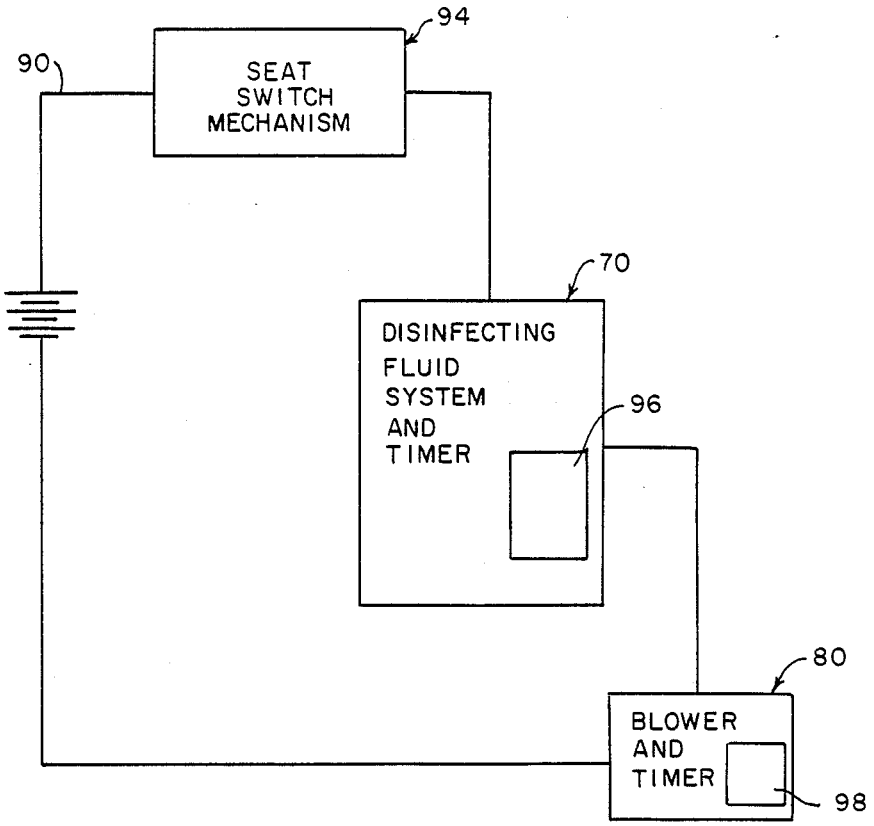
FIG. 4 is a schematic of the control and power elements used in the toilet seat cover system of the present invention.

This sequence of co-operative operation is indicated in FIG. 4 and is controlled by the control and power assembly 28 mounted on the side of the tank and connected to the liquid assembly 70 by leads 90 and to gas unit 80 by leads 92. The assembly 28 includes suitable timers which are actuated and will send suitable signals as indicated in FIG. 4. Thus, the seat cover and seat have a switch mechanism 94 which signals the fluid system, which has a timer 96, as soon as the cover is engaged against the seat in sealing relation thereto after it has been lifted away therefrom. The fluid system timer then operates for a selected period of time to impinge fluid against the seat, and then sends an appropriate signal to the gas system to actuate that system. The gas system has a timer 98 that causes that gas system to operate for a time that is selected to ensure a complete drying of the seat, and then sends a signal to the switch mechanism to re-set that mechanism. Power for all operations of the system is supplied from a suitable power source, indicated in FIG. 4 as battery 100, but the system can be operated by utility power if desired.

Figure 5:
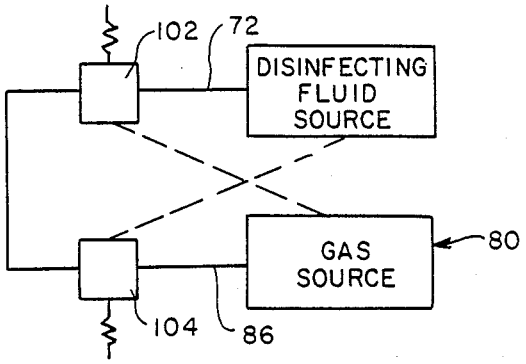
FIG. 5 is a schematic of the fluid circuit used in the system of the present invention.

To ensure that the liquid from the system 24 does not enter the gas system 26, the seat cleaning system includes flow control valves 102 and 104, as best shown in FIG. 5. These valves are both solenoid operated valves that are operated according to the operation of the gas and liquid systems. Thus, valve 102 is normally open and fluidically connects the hose 60 to the conduit 72, except when the solenoid is actuated. When the solenoid is actuated, the valve 102 closes thus preventing fluid connection between the hose and the conduit 72 and preventing fluid communication between the hose and the fluid system 70. Solenoid operation for the valve 102 is controlled by the control unit 28 according to the beginning of operation of the gas unit 80 as indicated in FIG. 5. The dotted line in FIG. 5 from the valve 102 to the unit 80 indicates this functional coupling to close the valve 102 as soon whenever the unit 80 is in operation. The dotted line actually leads through the control unit 28, but is shown as directly connecting the unit 80 to the valve 102 for clarity.

Likewise, the valve 104 is a solenoid operated normally closed valve that is opened as soon as the liquid assembly 70 shuts down. Again, control of this valve is exercised by the control unit 28, but is shown in FIG. 5 as being directly connected to the liquid unit 70 for the purpose of emphasizing that it is operation of the assembly 70 that keys operation of the valve 104.

Thus, when the unit 70 is in operation, the unit 80 is sealed off from the hose, and when the unit 80 is in operation, the unit 70 is sealed off from the hose. In this way, there will be no co-mingling of fluids from the two units 70 and 80. The control unit 28 is connected to the valves via lines, such as line 106 shown in FIG. 1.

It is to be understood that while certain forms of the present invention have been illustrated and described herein, it is not to be limited to the specific forms or arrangement of parts described and shown.

I claim:

1. A cleaning and sanitizing system for a toilet comprising:

(A) a toilet seat having an outer perimeter and an upper surface, wherein said seat is adapted to be mounted on a toilet bowl having an inner volume;

(B) a toilet seat cover having an outer periphery and a lower surface wherein said cover is adapted to be pivotally mounted on the bowl to cover and uncover the toilet seat;

(C) locking and sealing means located on said cover and said seat for sealing said cover to said seat in a fluid tight manner when said cover is in a closed position, said locking and sealing means includes (1) a groove defined in and extending adjacent to said toilet seat outer perimeter for the extent of the outer perimeter of said seat, (2) a flange depending normally from said lower surface about said said outer periphery of said cover, said flange being located to engage the outer surface of said seat when said cover is in a closed position, and, (3) an elongated tongue extending radially inwardly from said flange over substantially the entire length of said flange and located to be adjacent to said groove for releasably engaging said groove when said cover is in a closed position thereby forming a fluid-tight seal therebetween, such that when said cover is in a closed position said upper surface of said seat is spaced apart from said lower surface of said seat cover thereby defining a gap therebetween connected to the inner volume of said bowl;

(D) a gas source assembly adapted to be mounted on a tank of the toilet, said gas source assembly including (1) a housing, (2) a fan located within said housing, (3) a gas inlet in said housing connected to said fan, (4) a heater located within said housing, (5) a gas outlet on said housing, (6) a timer for stopping operation of said gas source assembly after a predetermined time of operation, and (7) starting means for starting operation of said gas source assembly;

(E) a liquid source assembly adapted to be mounted on the tank of the toilet, said liquid source assembly including (1) a container adapted to be mounted on the toilet tank, (2) a liquid reservoir located within said container, (3) a pump fluidically connected to said reservoir, (4) a fluid outlet on said container fluidically connected to said reservoir, (5) a timer for stopping operation of said liquid source assembly after a prescribed time of operation, and (6) starting means for starting operation of said liquid source assembly;

(F) a control and power means adapted to be mounted on the toilet and including (1) switch means connected to said toilet seat to be actuated when said seat has been closed, (2) means connected to said liquid source assembly starting means for starting operation of said liquid source assembly when said toilet seat is closed, (3) means connected to said gas source assembly starting means for starting operation of said gas source assembly after said liquid source assembly has been shut down, (4) means connected to said gas source assembly to re-set said switch to an unactuated condition after said gas source assembly has been shut down, and (5) power means connected to both of said liquid source assembly and said gas source assembly; and (G) a hose mounted on the lower surface of said cover located in said gap above said upper surface of said seat when said cover is in a closed position, said hose including (1) a liquid inlet fluidically connected to said liquid source assembly outlet, (2) a gas inlet fluidically connected to said gas source assembly outlet, (3) a multiplicity of fluid outlets in said hose located to direct gas and liquid against the upper surface of said toilet seat and being angled to direct such gas and liquid into the toilet bowl inner volume to wash and dry said toilet seat by impinging fluid thereagainst; and (H) fluid control means on said hose for preventing liquid from passing from said hose to said gas source assembly and for preventing gas from said hose from passing to said liquid source assembly.

2. The cleaning and sanitizing system defined in claim 1 wherein said groove has a depth as measured between the outer surface of said seat and a bottom of said groove which varies from a first depth at a first location on said seat to a second depth at a second location on said seat.

3. The cleaning and sanitizing system defined in claim 2 wherein said seat includes a distal portion and a proximal portion, and said first location is adjacent to said distal portion and said second location is adjacent to said proximal portion.

4. The cleaning and sanitizing system defined in claim 3 wherein said proximal portion is located adjacent to a connection of said cover to said bowl.

5. The cleaning and sanitizing system defined in claim 4 wherein said tongue has a width as measured between a root thereof and an cover edge and that varies in conjunction with the variation of said groove depth.

6. The cleaning and sanitizing system defined in claim 5 wherein said fluid control means includes a first shut-off valve fluidically interposed between said hose and said gas source assembly and a second shut-off valve fluidically interposed between said hose and said liquid source assembly.

7. The cleaning and sanitizing system defined in claim 6 wherein said first shut-off valve is a normally closed solenoid valve and said second shut-off valve is a normally open solenoid valve, with both of said shut-off valves being connected to said control and power means.

* * * * *